United States Patent [19]

Vetter

[11] Patent Number: 4,620,759

[45] Date of Patent: Nov. 4, 1986

[54] PRELOADED ELECTRICAL CONNECTOR UTILIZING ANGULARLY GROUPED PAWLS FOR BOTH INDEXING AND LATCHING OF PLUG AND RECEPTACLE COMPONENTS

[75] Inventor: Ottomar H. Vetter, New Hope, Minn.

[73] Assignee: TRW Inc., Redondo Beach, Calif.

[21] Appl. No.: 504,410

[22] Filed: Jun. 15, 1983

[51] Int. Cl.[4] ..... H01R 13/62

[52] U.S. Cl. ..... 339/45 M; 339/46; 339/DIG. 2

[58] Field of Search ..... 339/DIG. 2, 45, 89, 339/90, 91 R, 46, 186, 69–73, 87

[56] References Cited

U.S. PATENT DOCUMENTS

| | | | |
|---|---|---|---|
| 3,008,116 | 11/1961 | Blanchenot | 339/DIG. 2 |
| 3,170,748 | 2/1965 | Van Horssen | 339/DIG. 2 |
| 3,328,743 | 6/1967 | Acord | 339/45 M |
| 3,393,927 | 7/1968 | Kelly et al. | 339/90 R |
| 3,455,580 | 7/1969 | Howard | 339/90 R |
| 3,609,632 | 2/1971 | Vetter | 339/45 M |
| 3,876,275 | 4/1975 | Clark | 339/90 R |
| 4,152,039 | 5/1979 | Shah | 339/DIG. 2 |

*Primary Examiner*—Joseph H. McGlynn

*Attorney, Agent, or Firm*—Robert W. Keller; John T. Wiedemann

[57] ABSTRACT

The releasable electrical connector includes two separable components. Pivotal pawls must pass between lands or keys in order to couple the two components together, thereby providing an indexing feature that prevents a mismating of components. Cam followers in helical grooves effect the coupling and are prevented from reverse movement in their respective grooves by the fingers of a detent fork that are urged into an obstructive relationship with the cam followers. Release of the coupled components is effective via a lanyard that pulls the coupling ring sleeve longitudinally to such an extent that the pawls pivot outwardly into an unlatching position.

23 Claims, 12 Drawing Figures

PRELOADED ELECTRICAL CONNECTOR UTILIZING ANGULARLY GROUPED PAWLS FOR BOTH INDEXING AND LATCHING OF PLUG AND RECEPTACLE COMPONENTS

BACKGROUND OF THE INVENTION

1. Field of the Invention

This invention relates generally to electrical connectors, and pertains more particularly to a quick-release connector having a lanyard for effecting the release.

2. Description of the Prior Art

Releasable electrical connectors are not new. Witness, for instance, the releasable electrical connector described in U.S. Pat. No. 3,609,632, granted on Sept. 28, 1971 to Ottomar H. Vetter for Releasable Electrical Connector and assigned to TRW, Inc., the assignee of the present invention. The connector of U.S. Pat. No. 3,609,632 will hereinafter be referred to as the Vetter releasable connector or Vetter releasable patent.

As explained in said Vetter releasable patent, there are situations where a high degree of reliability in a connector is demanded. The alluded-to patent also points out that a number of important features desired in a releasable connector had previously been incorporated into connector designs, and even a combination of desirable features in a single connector, but that there still remained at that time the need for a releasable connector containing even more features than previously made available in a single connector. Without question, the Vetter releasable connector has performed admirably in practice. Even so, it has turned out that certain features incorporated into the Vetter releasable connector warranted improvement, and that still other features should be added, yet any improved connector should maintain the degree of reliability and compactness possessed by the Vetter releasable connector.

Reference should also be made to another Vetter patent, this patent being U.S. Pat. No. 3,750,087, granted on July 31, 1973 for Preloaded Electrical Connector and also assigned to TRW, Inc. The connector of this patent will be hereinafter referred to as the Vetter preloaded connector or Vetter preloaded patent. The preloading feature is extremely important in installations where considerable vibration is apt to be encountered, and this feature is incorporated into the instant invention.

SUMMARY OF THE INVENTION

Accordingly, a general object of the present invention is to improve upon the basic capabilities of the Vetter connector, yet add features which will provide a releasable electrical connector that will even better meet rigid military and aerospace specifications.

One important object of the instant invention is to provide an improved latching arrangement for a releasable electrical connector. In this regard, it is an aim of the invention to provide a number of pivotal pawls that will automatically effect the release of one connector component from a second connector component with which it has been mated, and which pawls also contribute to the indexing or polarity matching of the two components in order to prevent inadvertent mismating of components with sometimes disastrous consequences.

Another object is to provide a latching arrangement for quick-release connector components in which relatively great forces can be withstood while the components are coupled together, yet which arrangement enables a very rapid release of the components when only a small amount of pulling force is applied to the lanyard.

Another important object is to provide a latching arrangement or mechanism for releasably retaining two components coupled together which mechanism is separate and distinct from the mechanism employed in effecting the initial coupling of the two components. In this regard, an aim is to use several cam followers acting in a corresponding number of helical ramp grooves to effect the coupling, and employ a plurality of pivotal pawls for maintaining the components coupled together until their release is desired.

Yet another object of the invention is to provide a releasable electrical connector in which the likelihood of relative motion is virtually eliminated, thereby effectively withstanding a high degree of vibration, shock and temperature changes. More specifically, an aim of the present invention is to incorporate into a releasable connector a preloading condition in general accordance with the teachings of the Vetter preloaded patent, such that the connector components are for all intents and purposes maintained in a securely coupled relationship, whereby a good electrical path between such components is maintained under extremely adverse operating conditions.

Although the present invention contemplates a preloading, as mentioned immediately above, a detent or locking mechanism is envisaged that provides an obstructive interference that will prevent any inadvertent uncoupling of the connector components once they have been fully coupled together.

Additionally, the invention has for an object the use of only a minimal amount of manual coupling effort in order to achieve a complete and rapid coupling of my connector.

Briefly, my invention contemplates a releasable electrical connector comprised of two separable components, more specifically, a receptacle component intended to be attached to an object to be jettisoned, such as a missile, and a plug component intended to remain attached to the aircraft or carrier from which the missile is to be launched. The receptacle component, which contains a number of socket contacts, includes a cylindrical shell having integral lands or keys exteriorally disposed thereon which form grooves or keyways therebetween. The plug component, which contains a number of pin contacts that are to be received or engaged in the socket contacts of the receptacle component, also includes a cylindrical shell adapted to fit within the receptacle shell, this smaller diameter shell having integral lands or keys interiorally disposed thereon forming grooves or keyways therebetween, these last-mentioned inner lands or keys complementing those outer lands or grooves on the plug sleeve.

A number of pawls are pivotally mounted on a carrier sleeve that encircles the plug shell. The pawls are angularly grouped on the carrier sleeve so that their teeth initially align with the outer grooves or keyways on the receptacle shell when a particular plug component having a given contact pattern is to be mated with a component having a corresponding contact pattern. If the pawls have been properly entered in the keyways, manual advancement of the plug component can occur. Twisting of an outer coupling ring sleeve, being longitudinally keyed to the pawl carrier sleeve, will cause a ramp groove sleeve, longitudinally keyed to the pawl carrier sleeve, to compress a spring washer, such as a Belleville washer (or a combination of spring washers) as cam followers extending radially inwardly from the pawl carrier sleeve approach or near the ends of helical ramp grooves provided in the ramp groove sleeve.

Owing to the longitudinal keying of the coupling ring sleeve to the pawl carrier sleeve, sufficient rotation of the pawl carrier sleeve, as a result of continued twisting of the coupling ring sleeve, will angularly shift the pawls, more specifically their teeth, into an obstructive relation with the innermost ends of the lands on the receptacle sleeve. The coupling ring sleeve maintains the pawls in their latched condition until the coupling ring sleeve, which has a lanyard attached thereto, is pulled to an axially displaced position which permits the pawls to pivot outwardly with the result that the plug component quickly separates from the receptacle component.

When fully coupled, a detent ring having three locking fingers, one for each cam follower, is moved axially by spring action so that the end portions of the locking fingers are moved across the ramp grooves to block reverse or uncoupling movement of the cam followers. Hence, in addition to the preloading feature, which primarily resists vibration and shock, there is a positive prevention of any uncoupling due to reverse movement of the cam followers in the grooves of the ramp groove sleeve.

DESCRIPTION OF THE PREFERRED EMBODIMENT

Figure 1:
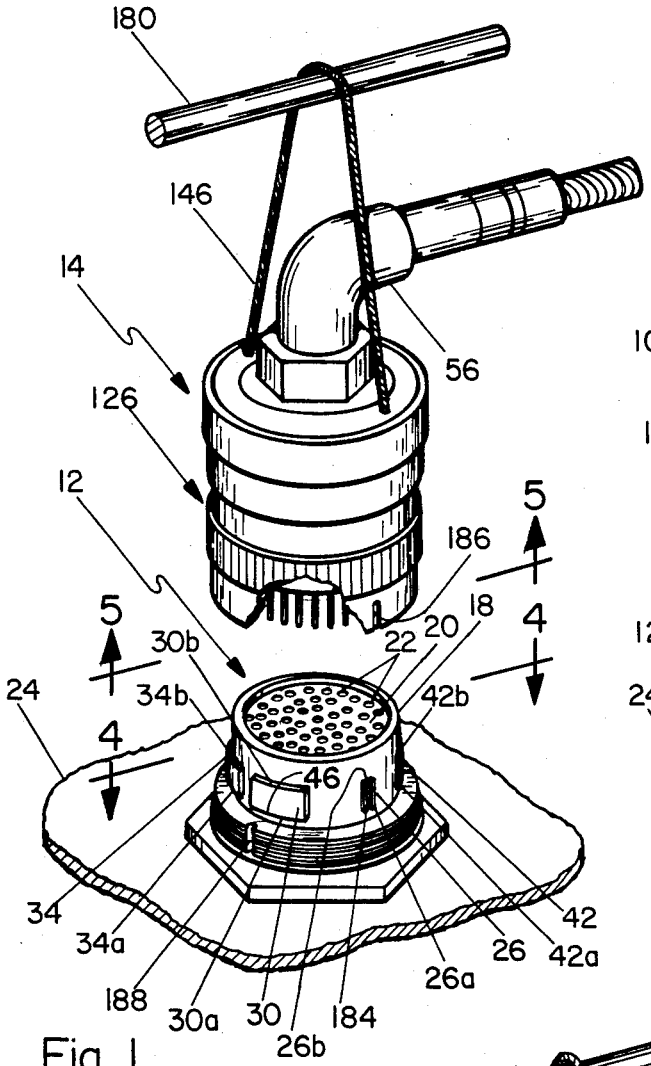
FIG. 1 is a perspective view of my connector with the lower or receptacle component ready to be moved upwardly in order to effect a coupling thereof with the upper or plug component.

Referring now in detail to the drawings, the quick-release electrical connector exemplifying my invention has been denoted generally by the reference numeral 10. The releasable connector 10 includes a first half in the form of a receptacle component 12 and a second half in the form of a plug component 14. Although the usefulness of my invention will be appreciated from the ensuing description, nonetheless additional information can be obtained, if desired, from said Vetter releasable patent.

Describing first the receptacle component 12, it will be perceived that it comprises a mounting flange 16 and a cylindrical metallic shell 18 extending upwardly therefrom. Within the shell 18 is an elastomeric insert 20 containing a number of socket contacts 22. The socket contacts 22 form a predetermined pattern that must be respected when the receptacle component 12 is coupled to the plug component 14, all as hereinafter made clear. Although said Vetter releasable patent may be referred to for additional details, for the sake of substantial completeness, it will be seen that the flange 16 is attached to an object 24 to be jettisoned, such as a missile or fuel tank.

Figure 4:
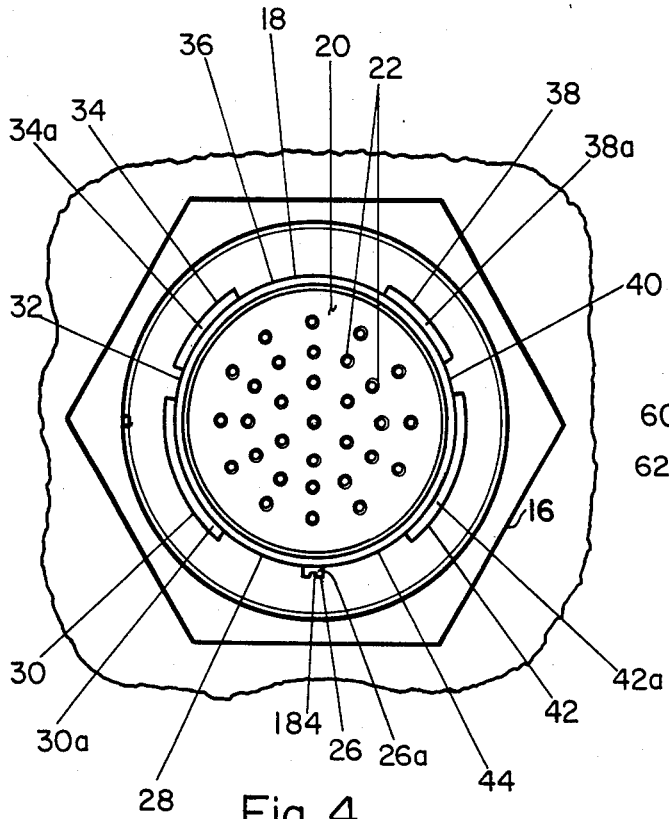
FIG. 4 is a top plan view of the lower or receptacle component, the view looking downwardly in the direction of line 4—4 of FIG. 1.
Figure 8:
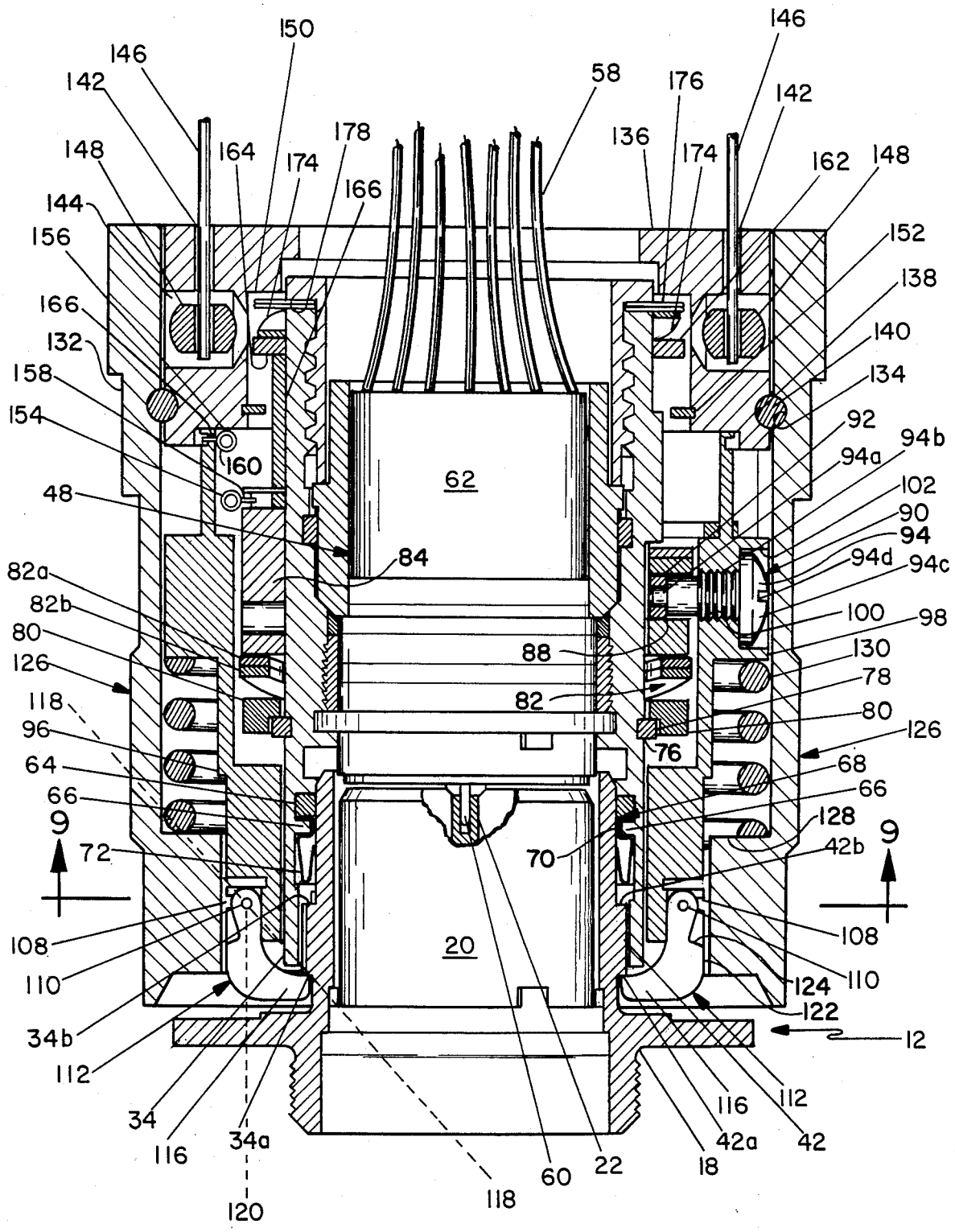
FIG. 8 is a sectional view taken in the direction of line 8—8 of FIGS. 3 and 7.

At this time, primary attention should perhaps be focused on FIG. 4, although a general understanding may be had from FIG. 1, too, where it will be discerned that at the 6:00 o'clock position there is a relatively narrow land 26 spanning an arc of 10°, the length of which land 26 appears in FIGS. 1 and 8. This land 26, as others presently to be referred to, are integral with the shell 18. Moving in a clockwise direction, as viewed in FIG. 4, there is a groove 28 spanning an angle of 35° that continues to a second land 30 that extends arcuately through an angle of 60°, followed by a groove or gap 32 of 10°. A third land 34 then spans an arc of 40°, followed by a groove or gap 36 of 60°. Still a fourth land 38 subtends an arc of 35°, followed by a groove or gap 40 of 15°. A land 42 extends over an angle of 60°, and a groove or gap 44 subtending an angle of 35° extends to the first-mentioned land 26. While varying in width, as indicated by the various angular values that have been mentioned, the lands are all of the same length, as can be discerned from the lands 26, 30, 34 and 42 visible in FIG. 1. As previously stated, the land 26 is situated directly at the 6:00 position. Obviously, the 6:00 o'clock position constitutes an arbitrary starting point for describing the lands 26, 30, 34, 38, 42 and the grooves 28, 32, 36, 40, 44 therebetween.

It will be appreciated that the lahds 26, 30, 34, 38, 42 and the grooves 28, 32, 36, 40, 44 vary considerably in the number of angular degrees that each embraces. As the description progresses, it will be seen that the various lands constitute ribs or keys. The grooves 28, 32, 36, 40 and 44 in between the lands 26, 30, 34, 38 and 42 form keyways for a purpose presently to be explained. It is important, though, to observe that the grooves or keyways 28, 32, 36, 40 and 44 are not of uniform width. This has been made clear, it is believed by the previously mentioned angular values given for each gap, groove or keyway 28, 32, 36, 40, 44.

From FIGS. 1 and 4–8, it will be perceived that the lower end of the land 26 has been indicated by the reference numeral 26*a*, whereas its upper end has been denoted by the reference numeral 26*b*. The lower ends of the other lands have been similarly identified as 30*a*, 34*a*, 38*a*, and 42*a*. The upper end of the land 38 does not appear in any of the figures but it will be recognized that it resides in the same horizontal plane as do the upper ends 26*b*, 30*b*, 34*b* and 42*b* of the lands or keys 26, 30, 34 and 42. The various lower ends 26*a*, 30*a*, 34*a*, 38*a* and 42*a* of the various lands or keys 26, 30, 34, 38 and 42 provide obstructions for a purpose presently to be explained.

Inasmuch as the ends 26*a*, 30*a*, 34*a*, 38*a* and 42*a* are spaced somewhat above the mounting flange 16, what amounts to an annular or circumferential groove 46 is formed. It will be understood, however, that the groove 46 is literally broken into segments by reason of the intervening grooves or keyways 28, 32, 36, 40, 44 that are formed between adjacent lands or keys 26, 30, 34, 38, 42.

Figure 5:
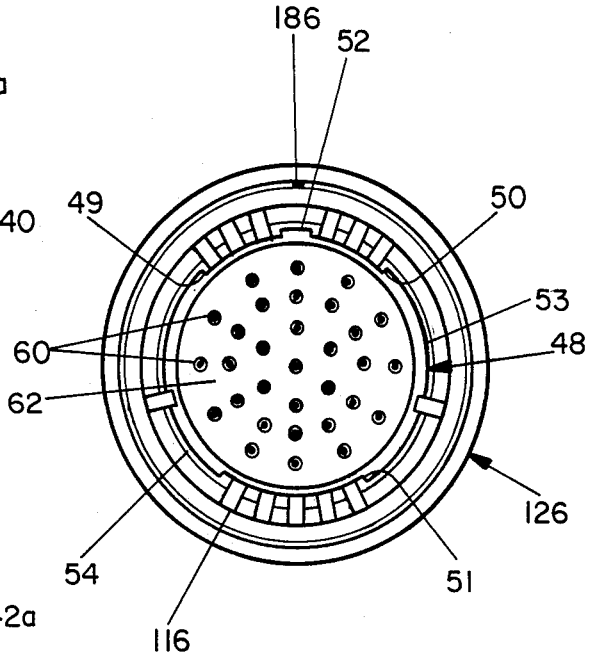
FIG. 5 is a bottom plan of the upper or plug component, the view looking upwardly in the direction of line 5—5 of FIG. 1.

Describing in detail the construction of the plug component 14, it can be appreciated that the component 14 includes a metallic shell 48 that is actually comprised of several parts. For simplification, however, the plug shell 48, even though composed of several parts will be referred to by the single reference numeral 48. The shell 48, as best seen in FIG. 5, has three inwardly projecting lands or keys 49, 50 and 51 forming grooves or keyways 52, 53 and 54 therebetween. The key or land 49 has a width corresponding to the groove or keyway 28, the key or land 50 a width equal to the groove or keyway 44 and the key or land 51 equal to the groove or keyway 36. The groove or keyway 52 has a width corresponding to the key or land 26, the groove or keyway 53 equal to the combined width of the keys or lands 38, 42 plus the groove or keyway 40 therebetween, and the groove 54 equal to the combined width of the keys or lands 30, 34 plus the width of the groove or keyway 32 therebetween. In this way relative longitudinal movement, which is needed during coupling of the connector 10, of the shells 18 and 48 is assured, any relative rotation being precluded by the interfitting of the various outwardly projecting keys or lands 26, 30, 34, 38 and 42 on the shell 18 between the inwardly projecting keys or lands 49, 50 and 51 on the shell 48. Thus, although integral with the part 54, the shell 48 can be said to additionally include a tubular neck 56 via which the various conductors 58, a number of which have been shown in FIG. 8, lead to pin contacts 60 contained in an elastomeric insert 62.

It will be understood that the pin contacts 60 have the same pattern as the socket contacts 22 in which the pin contacts 60 are to be engaged. It will also be appreciated at this stage that the receptacle and plug components 12 and 14, respectively, must be angularly oriented or indexed so that, when coupled, each specific pin contact 60 will be properly received in the particular socket contact 22 with which it is intended to be engaged. Otherwise, erroneous electrical paths would be established, frequently with injurious results to the electrical systems aboard the aircraft and/or the missile or other object 24.

While not particularly important to a practicing of the instant invention, nonetheless attention is directed at this time to an internally disposed annular groove 64 formed in the shell 48, actually in the part labeled 50. Projecting inwardly from the base of the groove 64 is an annular rib 66, the annular rib 66 actually forming upper and lower portions of the groove 66. Contained in the lower portion of the groove 64 is a grounding metallic ring 68 having a U-shaped portion 70 that extends over the inner edge of the rib 66. The grounding ring 68 further includes a plurality of tines or fingers 72, the tines or fingers 72 being resilient so that the free ends thereof engage the outer surface of the cylindrical shell 18 belonging to the receptacle component 12.

At this time, it should be observed that there is a circumferential groove formed at 76 in the exterior of the shell 48. Within the circumferential groove 76 is a split ring 78 having a square cross section, although the specific cross section is not important as a practical matter. The split ring 78 is used to prevent a locking ring 80 from moving downwardly as viewed in FIG. 8. Supported on the upper side of the locking spring ring 78 is a washer 82, such as a Belleville washer, having a specific cross section, such as that more fully discussed in said Vetter preloaded patent. The spring washer 82, it will be recognized, can assume various cross sections depending upon the preloading result to be achieved. Furthermore, the washer 82 can comprise two or more resilient washers, such as individual wave washers 82*a* and 82*b*. Consequently, the particular cross section of the washer 82 will depend upon the particular service to which the connector 10 is to be put and, as already indicated, the cross section of whatever washer 82 is used can be modified to suit the particular circumstances.

Figure 12:
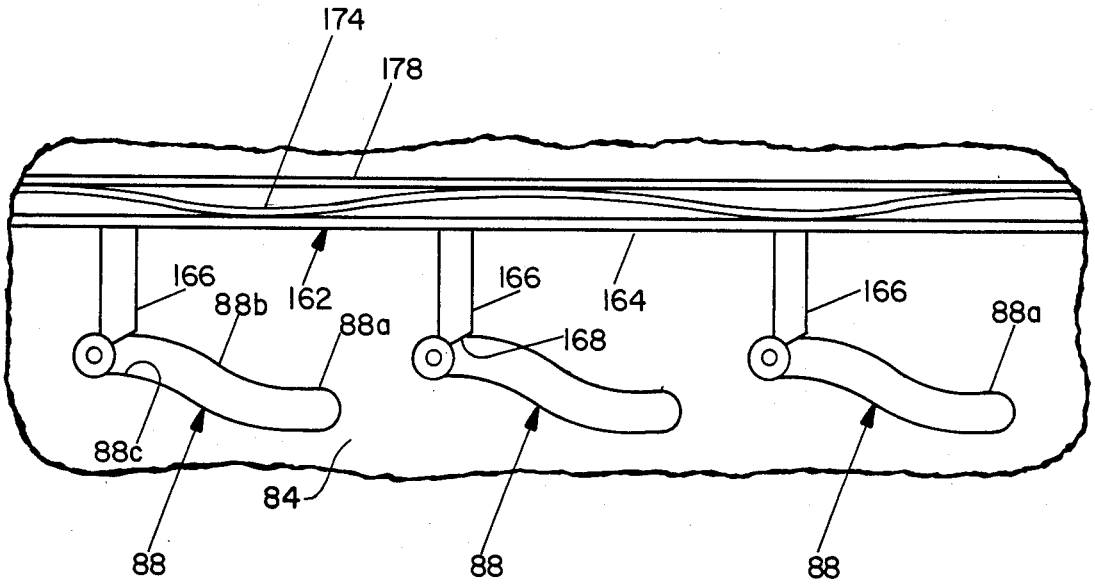
FIG. 12 is a fragmentary developed view of the three ramp grooves, each with a roller at the coupling end thereof and a detent finger shown blocking the roller.

Encircling the shell 48 of the plug component 14 is a ramp groove sleeve 84. As its name implies, the ramp groove sleeve 84 contains several ramp grooves 88 (see FIGS. 10 and 12). The ramp grooves 88, somewhat helical, are identically configured, being formed in each instance of a lower portion 88*a*, an intermediate upwardly inclining portion 88*b*, and finally an upper end portion 88*c*, the end portions 88*a* and 88*c* for all intents and purposes being parallel, but residing in vertically offset horizontal planes.

Coacting with the helical ramp grooves 88 is an equal number of cam followers, each being denoted generally by the reference numeral 90 and identical to the others. As can be seen from FIG. 8, the cam follower 90 thereappearing includes a roller 92 which rides in the particular ramp groove 88 with which its cam follower 90 is associated. The cam follower 90 also includes a screw 94 having a tip 94*a* on which the roller 92 is rotatably mounted, a threaded shank 94*b*, and an enlarged head 94*c* having a screw driver slot 94*d* therein.

At this time, reference will be made to a pawl carrier sleeve indicated generally by the reference numeral 96. The pawl carrier sleeve 96 is provided with three outwardly directed keys 98 located at 120° angles with respect to each other. From FIG. 8, it will be perceived that the key 98 appearing in this particular view, as are the other keys 98, is sufficiently wide so as to permit the forming or providing of a threaded hole 100 having a counterbore 102. The threaded hole 100 receives therein the threaded shank 94*b* of the screw 94 in each instance, whereas the counterbore 102 accommodates therein the head 94*c* of the screw 94 in each instance.

Figure 6:
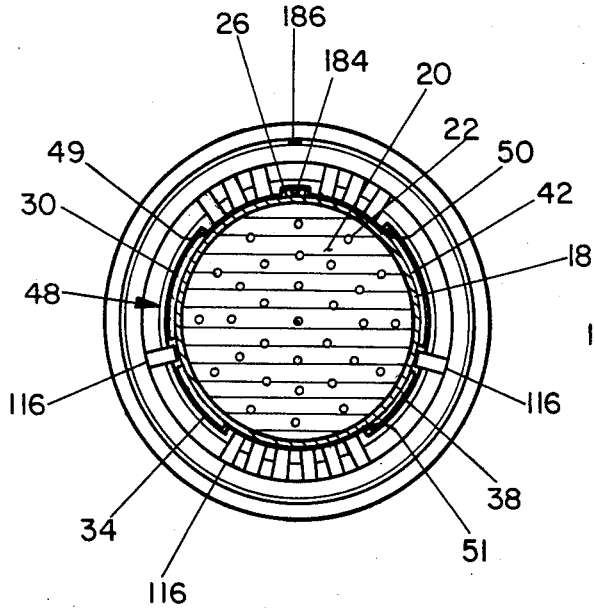
FIG. 6 is a sectional view in the direction of line 6—6 of FIG. 2, the view resembling the bottom plan view of FIG. 5 but with the lower half inserted.
Figure 7:
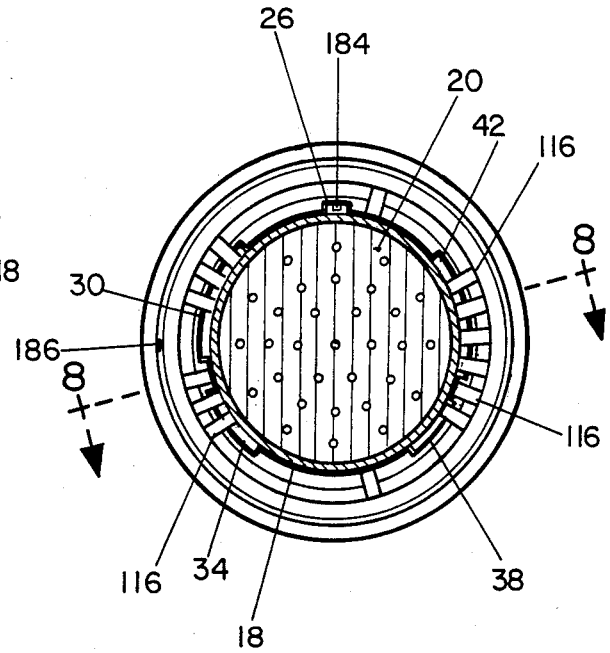
FIG. 7 is a sectional view in the direction of line 7—7 of FIGS. 3 and 9, this view also resembling the bottom plan view of FIG. 5 but with the lower half coupled to the upper half.
Figure 9:
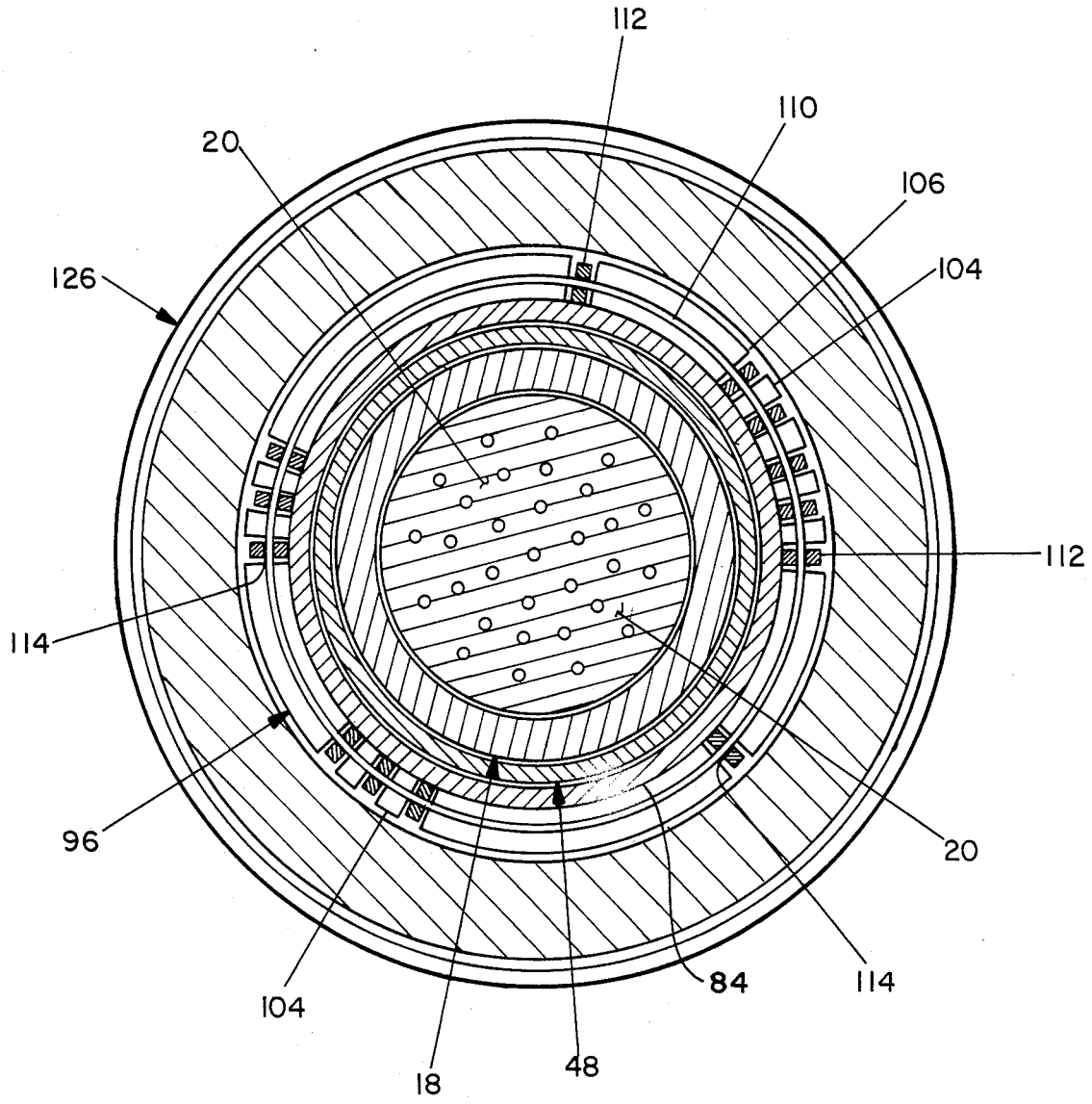
FIG. 9 is a sectional view taken in the direction of line 9—9 of FIG. 8.

Although generally comprehensible from FIGS. 5, 6 and 7, it will be better understood from FIGS. 8 and 9 that the lower end of the pawl carrier sleeve 96 is provided with a number of lugs 104 formed by slots 106. Each so-called lug 104 has a radial slot 108 (FIG. 8) therein for the accommodation of a section of wire 110.

The wire 110, forming a horizontal circle when viewed upwardly (as in FIG. 9) or downwardly, actually provides a pivot point for each of a number of pawls 112, the pawls 112 being grouped in accordance with the width of the previously mentioned slots or keyways 28, 32, 36, 40, 44, the wider slots or keyways 28, 36 and 44 having a proportionally larger number of pawls 112 than the slots or keyways 32 and 40, as is believed evident from FIG. 7.

Describing the pawls 112 with greater particularity, it is to be observed that each pawl 112 has a hole at 114 which furnishes the pivot point alluded to above because the wire 110 passes therethrough. At the other end of each pawl 112 is a tooth portion 116. At this stage it will merely be mentioned that a straight line 118 (shown lightly in FIG. 8 for the pawl 112 appearing at the left) extending between the pivot point provided by the hole 114 (which encircles the wire 110) and each tooth portion 116 is at an angle at least as great as 15° with respect to a vertical line 120 (also shown lightly in FIG. 8). The reason for this angle will soon be made clearer. The pawl 112 in each instance has a straight outer portion 122 and a notch portion 124 adjacent thereto. Once again, the manner in which the pawls 112 are permitted to pivot in order to effect a release of the two connector components 12 and 14 will be dealt with in greater detail shortly.

A coupling ring sleeve 126 has an internal shoulder at 128 against which one end of a coil spring 130 bears. The other end of the coil spring 130 bears against the several keys 98. It should perhaps be mentioned at this particular stage that the coil spring 130 determines the load or pull that will effect a release of the two connector components 12 and 14 which comprise the electrical connector 10. The spring constant, as far as the spring 130 is concerned, can be selected so that the release is realized when a predetermined load is applied in a direction to separate the two components 12, 14.

The coupling ring sleeve 126 has a cylindrical upper end labeled 132 which acts as an outer bearing race, having an inner semicircular groove 134 formed therein. Within the cylindrical end portion 132 is an inner lanyard race 136. The inner race 136 is formed with a semicircular groove 138. A series of ball bearings 140 ride in the two grooves 134 and 138 so that the coupling ring sleeve 126 is rotatable with respect to the lanyard race 136. There are two diametrically located passages 142 that are directed longitudinally or axially through the inner race 136, leading into a pair of radially directed recesses 144. In this way, a lanyard 146 can have its ends anchored within the recesses 144 by means of a pair of beads 148 that are crimped to the ends of the lanyard 146. Even though the reason therefor will not be appreciated at this time, nonetheless attention is drawn to an inner groove 150 formed in the inner race 136. This groove 150 has placed therein a ring 152 that performs a function better reserved for subsequent discussion.

There are two garter coil springs 154 and 156, although a larger number could be utilized, which function to rotatively return the coupling ring sleeve 126 to its original or initial position with respect to the pawl carrier sleeve 96 when the connector components 12, 14 have been released by reason of the pawls 112, more specifically their teeth 116, having been allowed to snap outwardly from their latched engagement with the ends **26*a*, 30*a*, 34*a*, 38*a*, 42*a* of the lands 26, 30, 34, 38, 42. To accomplish the rotative return of the coupling ring sleeve 126, one end of each spring 154, 156 is fixedly anchored or attached, as at 158, to the ramp groove sleeve 84, whereas the other end of each spring 154, 156 is anchored to the pawl carrier sleeve 96, as at 160 (see FIG. 8**).

What will be termed a detent fork 162 will now be described. The fork 162 includes a base ring 164 having three fingers or strips 166 projecting downwardly from the base ring 164 (see FIG. 10). The free ends of the fingers 166 are angled at 168, providing cam surfaces that are acted upon by the rollers 92 of the cam followers 90 as the cam followers 90 approach the upper ends of the ramp grooves 88. The free ends of the fingers 166 are also curved at 170, the curvature conforming to that of the rollers 92, as can be understood from FIGS. 10 and 12. The fingers 166, which are located at 120° angles with respect to each other (see FIG. 10), are slidably received in three longitudinally directed slots 172 formed in the ramp groove sleeve 84, thereby enabling the angled ends 168 to extend into the ramp grooves 88. A wave washer 174 acts against the base ring 164, being confined between the base ring 164 and a pair of retention rings 176 disposed in a circumferential groove 178 formed at the upper end of the shell 48. Thus, the detent fork 162 is biased by the waver washer 174 in a downward direction, but yielding when the rollers 92 act against the angled ends 168 of the fingers 166.

Operation

Having presented the foregoing description, the manner in which my connector 10 functions should be readily appreciated. Nonetheless, in order that the various benefits to be derived from a practicing of my invention can be fully taken into account, a rather abbreviated operational sequence will now be given. Of course, it should be borne in mind that reference can be made to said two Vetter patents in order to obtain a more comprehensive understanding of the uses to which my present connector 10 can be put and the problems attending such uses.

In any event, it is planned that the receptacle component 12, at the outset, be secured to the particular item 24 to be released or jettisoned. The plug component 14, through the agency of the lanyard 146, would be strung over a bar or similar member 180 that would be within a pylon or attached to the underside of an airplane wing. It is due to the limited amount of space within the usual pylon that a problem arises because the interior is so restricted that the manual coupling of any type of releasable connector is difficult to achieve.

It is important to realize that the two shells 18, 48 have a key and keyway scheme or pattern that will permit a mating or coupling of the plug component 14 with the receptacle component 12 in only one angular relationship with each other. In this regard, there is the one narrow land or key 26 at the 6:00 o'clock position (FIG. 4) and the additional wider lands or keys 30, 34, 38 and 42 forming the grooves or keyways 28, 32, 36, 40 and 44 therebetween. Consequently, a number of different polarizing schemes can be adopted.

In practice, six different polarizing or indexing arrangements are contemplated. It is the grouping of the various pawls 112 that determine which specific one of the basic polarity schemes will be utilized for a given connector 10. In other words, without the pawl feature provided by my invention, one could attempt to mate or couple the two components 12, 14 in any one of six (or whatever number exists) ways. However, by utilizing the pawls 112 in the indexing or polarity determining scheme, only one angular orientation of the components 12, 14 becomes acceptable and the proper engagement of the contacts 22, 60 is assured.

Figure 2:
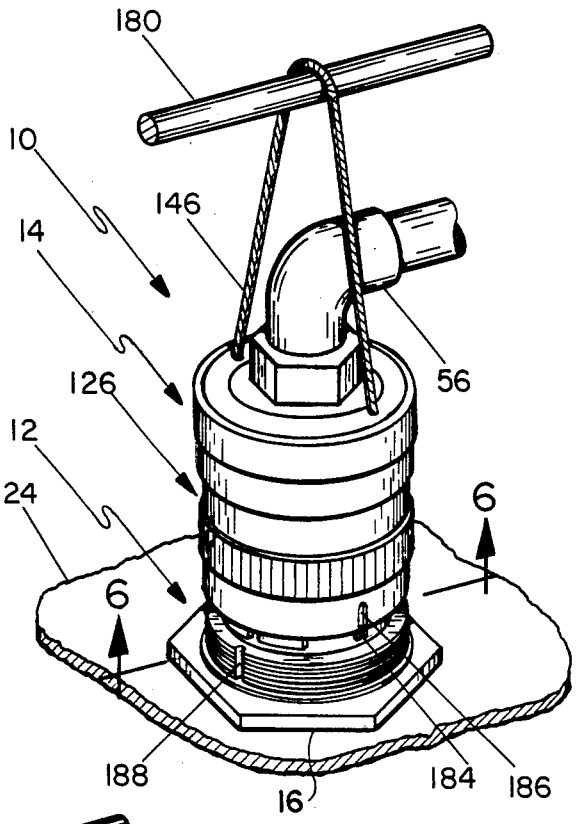
FIG. 2 is a perspective view of my connector with the lower half inserted into the upper half, but before being twisted to effect the coupling together of the two parts.

Assuming that the depicted components 12 and 14 are intended to be mated together, then all that the operator need do is to initially longitudinally advance the plug component 14 axially or longitudinally toward the component 12. He may have to twist the two components 12, 14 relative to each other in order to orient the lands and grooves of each so that further axial movement can be achieved. To facilitate the alignment procedure, the land 26 on the receptacle component 12 is provided with a groove 184, the base of which is also colored, say, blue for ready recognition. The shell 18 of the plug component 14 is embossed with a groove 186, which is colored, say, red. The user merely sees to it that the grooves 184 and 186 are initially brought into longitudinal registry or alignment, as understandable from FIGS. 1 and 2.

Once the lands and grooves are aligned, then the various pawls 112, by virtue of their predetermined groupings, will enter the keyways or grooves 28, 32, 36, 40 and 44 on the inner shell 18, that is, the shell belonging to the receptacle component 12. If the pawls 112 are grouped for mating with a different receptacle component 12 than intended, then the grouping would be such that the pawls 112, more specifically the teeth 116 thereon, would not enter the grooves or keyways 28, 32, 36, 40 and 44 between the lands 26, 30, 34, 38 and 42 on the inner shell 18, that is, the shell belonging to the receptacle component 12. In other words, the pawls 112 provide the keying geometry which require the connector components 12, 14 to be properly aligned before mating, and if the two components 12, 14 are not designed to be mated together, then an obstructive interference would occur by virtue of the fact that the teeth 116 would not enter the keyways 28, 32, 36, 40 and 44 between the lands 26, 30, 34, 38 and 42. The failure of just one pawl 112 to enter a keyway will prevent the connector components 12 and 14 from being coupled. When using, say, thirteen pawls 112, as illustrated in FIGS. 5–7 and 9, the precision indexing derivable when practicing my invention becomes readily understandable for all thirteen (or whatever number is selected) must enter the five (or whatever number is selected) before the connector 10 can be coupled.

As herebefore explained, provision is made for incorporating into the present connector 10 the preloading feature described in the Vetter preloaded patent. This is accomplished through the agency of the Belleville washer 82, more specifically, the two washers 82*a* and 82*b* that have been depicted. Thus, while the cam followers 90 acting on the sides of the helical ramp grooves 88 forcibly advance the ramp groove sleeve 84 downwardly, this being by virtue of the fact that the coupling ring sleeve 126 is causing the pawl carrier sleeve 96 to move by reason of the keys 98 on the pawl carrier sleeve 96 being slidably received in keyways 182 (FIG. 9) within the interior of the coupling ring sleeve 126, the ramp groove sleeve 84, owing to its ramp grooves 88, is thus being urged downwardly by virtue of the cam followers 90. However, when the inserts 20, 62 within the two cylindrical shells 18, 48 abut each other, then the spring washer 82 will begin to distort, applying its predetermined load, which load is obtained by adjusting a threaded retaining ring corresponding to the ring 64 shown in said Vetter preloaded patent.

When the pawls 112, more specifically their teeth 116, have passed through the pawl carrier sleeve 96, this sleeve 96 will then be rotated sufficiently so as to shift the teeth 116 into an obstructive relationship with the ends 26*a*, 30*a*, 34*a* 38*a* and 42*a* of the lands 26, 30, 34, 38 and 42. Two pawls 112, these being the ones visible in FIG. 8, have been depicted in their obstructive relationship with the particular lands or keys 34 and 42 (see FIG. 7 also).

Figure 10:
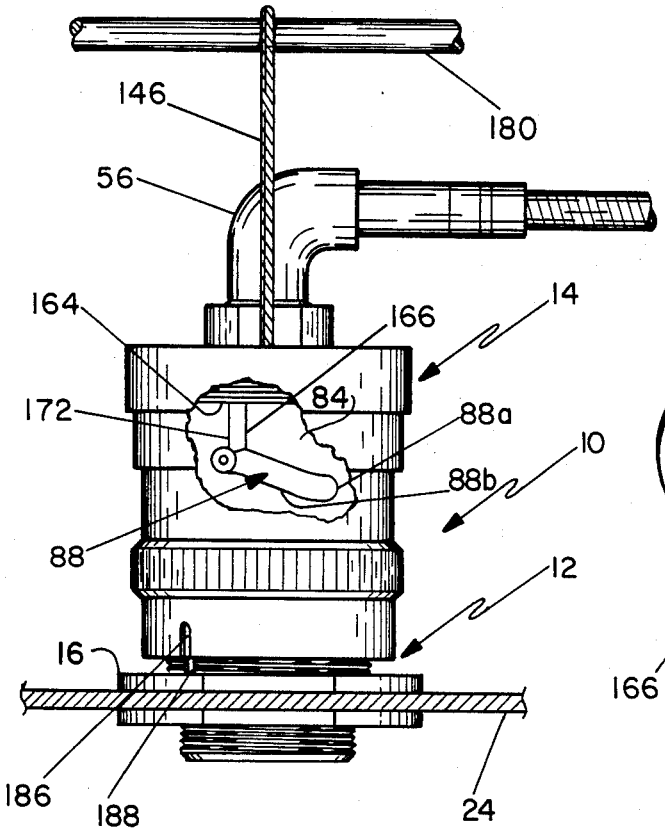
FIG. 10 is a view showing the components coupled together, an outer portion of the connector having been removed in order to show one of the ramp grooves with one of the detent fingers in blocking relation with the cam follower received in this particular ramp groove.
Figure 11:
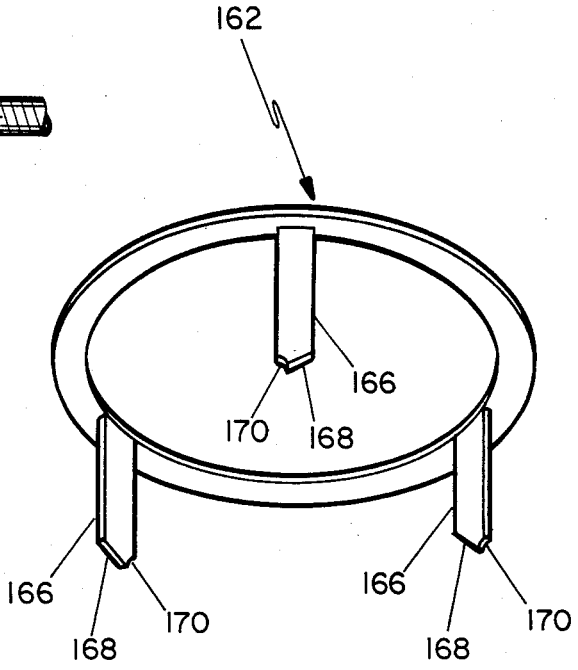
FIG. 11 is a perspective view of the detent fork comprising a ring and three fingers extending therefrom, the ring and one finger sectionally appearing in FIG. 8 and a segment of the ring and one finger elevationally appearing in FIG. 10.

Owing to the angled ends 168 on the three fingers 166 belonging to the detent fork 162, it will be recognized that the detent fork 162 will be urged upwardly as viewed in FIGS. 8 and 10, flattening the wave washer 174. Once the cam followers 90, more specifically the rollers 92 thereof, reach the upper ends of the ramp grooves 88, then the wave washer 174 acts against the base ring 164 of the detent fork 162 so as to move the three fingers 166 into obstructive interference with the rollers 92 so that they are held captive. Of course, the angled edges 168 are literally cammed upwardly by the rollers 92 as the cam followers 90 near the ends of the ramp grooves 88. While the preloading achieved through the agency of the spring washer 82 reduces the chance of there being an unwanted release of the connector components 12 and 14, the interference provided by the three fingers 166 with respect to the rollers 92 assure that the connector 10 will remain coupled.

During the coupling procedure, that is, while the rollers 92 of the cam followers 90 are advancing within the ramp grooves 88, the garter springs 154 and 156 are being stretched somewhat by reason of the relative rotation of the pawl carrier sleeve 96 with respect to the ramp groove sleeve 84. Of course, the outer coupling ring sleeve 126 is keyed to the pawl carrier sleeve 96 so that whatever subsequent rotation results from the contraction of the garter springs 154, 156 will act upon the outer coupling ring sleeve 126 to return it to its initial rotative position.

Figure 3:
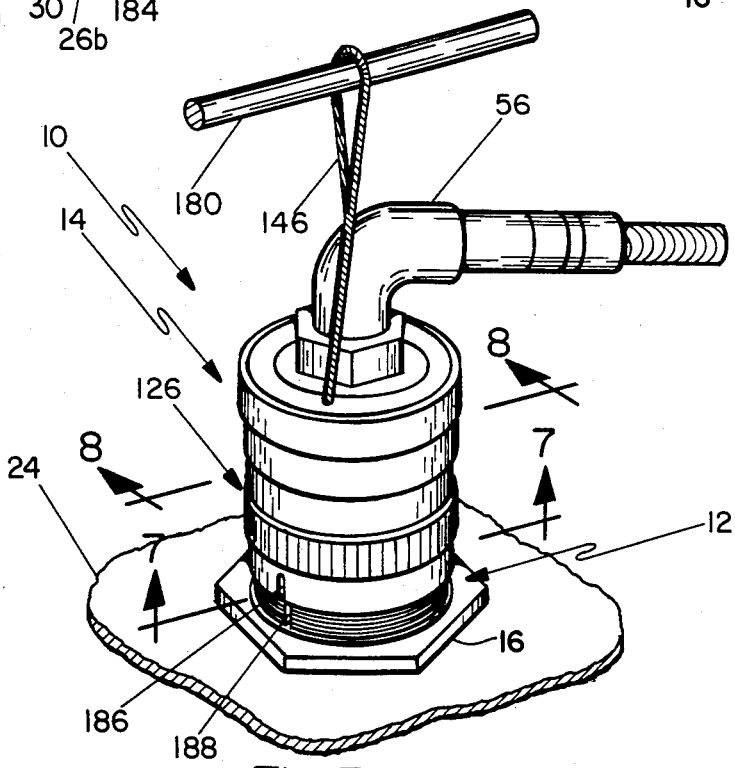
FIG. 3 is a perspective view of my connector after coupling of the parts has been completed.

With the connector 10 fully mated, that is with the pin contacts 60 completely received within the socket contacts 22 the groove 186 will have been angularly shifted so as to register with a groove 188 formed in the receptacle component 12, thereby visually apprising the user that coupling has been effected (see FIG. 3). The coupling is physically assured when utilizing the teachings of my invention because the pawls 112 have at this stage been angularly shifted into a latching or obstructive relation with the lands 26, 30, 34, 38 and 42, more specifically, the teeth 116 with respect to the ends 30*a*, 34*a*, 38*a* and 42*a* of the lands 30, 34, 38 and 42. There can now be no inadvertent release because the pawls 112 are held in their latched condition by reason of the outer coupling ring sleeve 126 being juxtaposed with respect to the teeth 116 of the majority of the pawls 112.

However, when a sufficient pull on the lanyard 146 is applied, so as to overcome the action of the coil spring 130, then the outer coupling ring sleeve 126 moves upwardly so that the notch portions 124 of the pawls 112 are brought into juxtaposition with respect to the lower end of the coupling ring sleeve 126, the pawls 112 then pivoting outwardly about their pivot points, the pivot points being established by virtue of the wire 110 and the holes 114 formed at the upper ends of the various pawls 112. Without the inward resistance supplied by the lower end of the coupling ring sleeve 126, the teeth 116 on the various pawls 112 immediately snap outwardly. It will be recalled that the angle between a line, which has been labeled 118, extending between the pivot point provided by the wire 110 and the teeth 116 is greater than 15° with respect to the axial line, which has been labeled 120, of the coupled components 12 and 14. With the coupling ring sleeve 126 no longer confining the pawls 112, they immediately spring outwardly to unlatch the pawl carrier sleeve 96, thereby releasing the shell 18. Since the object 24 to be jettisoned is attached to the receptacle component 12, it is released while the plug component 14 is retained in an attached relationship with the aircraft to which the lanyard 146 is connected.

Close inspection of FIG. 8, that is, toward the upper portion thereof, will reveal that there is a vertical space between the inwardly projecting ring 152 and the base ring 164 belonging to the detent fork 162. Thus, the inwardly projecting ring 152 must travel through that vertical distance before there is any withdrawal of the fingers 166 from the obstructive relationship they have been providing with the rollers 92. However, once the ring 152 strikes the base ring 164 of the detent fork 162, the fingers 166, being integral with the base ring 164, are quickly retracted so that the rollers 92 are no longer blocked by the fingers 166 and are retracted from the ramp grooves 88 into which they were advanced during the coupling action suplied by the coupling ring sleeve 126. Also, under these conditions, the two garter springs 154, 156 simply rotatively return the outer coupling ring sleeve 126 to its original position so that the connector component 14 can be recoupled to another receptacle component 12, as long as the new receptacle component 12 has the same polarity or indexing scheme that is furnished by the grouping of the various pawls 112 for the component 12 just released.

I claim:

1. A releasable electrical connector comprising a first component including a first shell containing therein a plurality of first contacts, said first shell having a plurality of longitudinally directed outer lands or keys forming angularly spaced grooves or keyways therebetween, a second component including a second shell containing therein a plurality of second contacts engageable with said first contacts, said second shell having a plurality of longitudinally directed inner lands or keys forming grooves or keyways therebetween, said outer keys being slidably receivable in said inner keyways and said inner keys being slidably receivable in said outer keyways, a sleeve member, a plurality of latch members pivotally mounted on said sleeve member and having portions thereof receivable in said outer keyways, said sleeve member being at least partially rotatable relative to said first and second shells so as to angularly shift at least some of said latch portions into an obstructive relation with the ends of said outer keys after said contacts have been engaged with each other, the reception of said outer keys between said inner keys preventing relative rotation of said first and second shells during the angular shifting of said latch portions, and additional means outwardly of said latch members for normally restraining movement of said latch members so as to maintain said obstructive relation.

2. A releasable electrical connector in accordance with claim 1 in which said ends of said outer keys reside in a radial plane and said latch portions also reside in said radial plane when in said obstructive relation.

3. A releasable electrical connector in accordance with claim 2 in which said latch members constitute pawls and said latch portions constitute teeth on the free ends of said pawls, the other ends of said pawls being pivotally mounted to said sleeve member.

4. A releasable electrical connector in accordance with claim 3 in which said pawls are angularly arranged about said sleeve member so that said teeth will be aligned with and enter at least some of said outer keyways when said components are to be coupled together.

5. A releasable electrical connector in accordance with claim 4 in which said pawls are grouped in accordance with the widths of said outer keyways, there being a larger number of pawls for wider keyways and a lesser number of pawls for narrower keyways.

6. A releasable electrical connector in accordance with claim 5 in which the angle between the longitudinal axis of the connector components when said components are coupled and a line extending between the tooth of each pawl and its pivot point is at least 15°.

7. A releasable electrical connector in accordance with claim 6 in which said additional means constitutes a coupling ring sleeve, said coupling ring sleeve bearing against outer portions of said pawls to maintain said teeth in said obstructive relation.

8. A releasable electrical connector in accordance with claim 7 in which said pawls each have a notch between its said outer portion and its said pivot point, said notches permitting outward pivoting and release of said connector components when one end of said coupling ring is moved into juxtaposition with said notches.

9. A releasable electrical connector comprising first and second shells of a size such that an end portion of said first shell fits in an end portion of said second shell, first contact means contained in said first shell, second contact means contained in said second shell, a plurality of angularly spaced lands on the outer surface of said first shell forming grooves therebetween, a sleeve member outwardly of said second shell, pivotal pawls on said sleeve member, said pivotal pawls having portions thereof receivable in the grooves formed between said lands and thus determining the polarity configuration of said shells, said pivotal pawls having teeth being angularly shiftable into an obstructive relation with said lands when said contacts are fully mated, means on said second shell engageable with at least one of said lands to prevent angular movement of said first shell relative to said second shell when said teeth are angularly shifted into said obstructive relation, and a coupling ring sleeve encircling said pawls so as to prevent outward pivotal movement of said pawls when said coupling ring sleeve is in one position and permitting outward pivotal movement when said coupling ring sleeve is in another position.

10. A releasable electrical connector comprising a first component including a first shell containing therein a plurality of first contacts, said first shell having a plurality of longitudinally directed outer lands or keys near one end thereof forming angularly spaced grooves or keyways therebetween, a second component including a second shell containing therein a plurality of second contacts engageable with said first contacts, said second shell being of a size to receive therein said one end of said first shell, a carrier sleeve encircling said second shell having a plurality of pivotal pawls adjacent one end thereof, said pawls thereof having portions longitudinally movable in at least some of said grooves and angularly shiftable into a latching engagement with at least some of said lands after said pawl portions have passed through said grooves, and means for restricting angular movement of said first shell relative to said second shell when said pawl portions are angularly shifted into said latching engagement.

11. A releasable electrical connector in accordance with claim 10 including means interconnecting said carrier sleeve to said second shell.

12. A releasable electrical connector in accordance with claim 11 in which said interconnecting means includes a ramp sleeve between said second shell and said carrier sleeve having a plurality of helical grooves therein, and a plurality of cam followers mounted on said carrier sleeve, portions of said cam followers projecting into said helical grooves.

13. A releasable electrical connector in accordance with claim 12 in which said interconnecting means also includes spring washer means and locking ring means anchored to said second shell, said spring washer means being between said ramp sleeve and said locking ring means.

14. A releasable electrical connector in accordance with claim 13 in which said spring washer means is compressed by said ramp sleeve as said cam followers near the end of said helical grooves.

15. A releasable electrical connector in accordance with claim 14 including a coupling ring sleeve, and said interconnecting means further including means longitudinally keying said coupling ring sleeve to said carrier sleeve.

16. A releasable electrical connector in accordance with claim 15 in which a portion of said coupling ring sleeve, when in one longitudinal position, engages and restrains said pawls in their said latched engagement.

17. A releasable electrical connector in accordance with claim 16 including spring means for urging said coupling ring sleeve into its said one longitudinal position.

18. A releasable electrical connector in accordance with claim 17 including a lanyard for pulling said coupling ring sleeve into a second longitudinal position to permit said pawls to pivot outwardly to unlatch said pawls from said lands.

19. A releasable electrical connector in accordance with claim 18 including detent means shiftable into a blocking relationship with said cam followers after said cam followers reach the end of said helical grooves.

20. A releasable electrical connector in accordance with claim 19 in which said detent means includes a longitudinally directed finger for each of said cam followers, said fingers each having an angled end acted upon by a cam follower as the cam followers near the ends of said helical grooves, and spring means for biasing said detent means into said blocking relationship, said cam followers overcoming the biasing action of said spring means when acted upon by said angled ends.

21. A releasable electrical connector in accordance with claim 20 in which said detent means includes a base ring encircling a portion of said second shell, said spring means for biasing said detent means into said blocking relationship acting on said base ring.

22. A releasable electrical connector in accordance with claim 21 including an inner lanyard race rotatable within said coupling ring sleeve, a ring carried by said inner race engageable with said base ring when said coupling ring sleeve has been pulled from its said first position to its said second position to retract said fingers from their said blocking relationship with said cam followers.

23. A releasable electrical connector comprising a first component including a first shell containing therein a plurality of first contacts, a second component including a second shell containing therein a plurality of second contacts, one end portion of said first shell being receivable within one end portion of said second shell to permit engagement of said first and second contacts, a ramp sleeve encircling an intermediate portion of said second shell, said ramp sleeve having a plurality of helical grooves therein and a longitudinal slot intersecting each of said helical grooves, a carrier sleeve encircling said ramp sleeve and said second shell, a plurality of cam followers on said carrier sleeve extending into said helical grooves, means for at least partially rotating said carrier sleeve to cause said cam followers to move said ramp sleeve longitudinally, a blocking finger slidably disposed in each slot, means biasing all of said fingers into said helical grooves to prevent reverse movement of the cam follower in said helical grooves, the ends of said fingers extending into said helical grooves being angled and said cam followers bearing against said angled ends to overcome the biasing of said fingers into said helical grooves to thereby allow said cam followers to proceed to the ends of said grooves, the fingers then moving by reason of said biasing means back into said helical grooves to prevent said reverse movement of said cam followers, a plurality of pawls on said carrier sleeve, land means on said first shell forming at least one longitudinally directed groove, said pawls being mounted on said carrier sleeve so as to have portions thereof enter said groove and move longitudinally therethrough as said cam followers cause said ramp sleeve to act in a direction to effect engagement of said first and second contacts, means for causing partial rotation of said carrier sleeve after said pawls have passed through said grooves to thereby angularly shift said pawls so that their said portions are moved out of registry with said groove into obstructive interference with said land means, and land means on said second shell receivable in said longitudinally directed groove for engaging said land means on said first shell to prevent relative rotation of said shells when said pawls are angularly shifted into said obstructive interference by said means for causing partial rotation of said carrier sleeve.

* * * * *